US007726132B2

(12) United States Patent
Savic

(10) Patent No.: US 7,726,132 B2
(45) Date of Patent: Jun. 1, 2010

(54) METHOD FOR INCREASING THE AERODYNAMIC STABILITY OF A WORKING FLUID FLOW OF A COMPRESSOR

(75) Inventor: Sasha Savic, Wettingen (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 12/004,434

(22) Filed: Dec. 21, 2007

(65) Prior Publication Data

US 2008/0168761 A1 Jul. 17, 2008

Related U.S. Application Data

(63) Continuation of application No. PCT/EP2006/063130, filed on Jun. 13, 2006.

(30) Foreign Application Priority Data

Jun. 27, 2005 (CH) ..... 1084/05

(51) Int. Cl.
*F02C 3/30* (2006.01)

(52) U.S. Cl. ..... 60/775; 60/39.3; 60/39.53; 60/39.55

(58) Field of Classification Search ..... 60/39.53, 60/39.55, 39.3, 775
See application file for complete search history.

(56) References Cited

U.S. PATENT DOCUMENTS

| | | | | |
|---|---|---|---|---|
| 2,974,482 | A * | 3/1961 | Kelley | 60/39.3 |
| 3,677,000 | A | 7/1972 | Thomson | |
| 5,329,758 | A | 7/1994 | Urbach et al. | |
| 5,458,457 | A * | 10/1995 | Goto et al. | 415/115 |
| 6,260,350 | B1 * | 7/2001 | Horii et al. | 60/39.3 |
| 2002/0112465 | A1 | 8/2002 | Payling et al. | |
| 2004/0163536 | A1 | 8/2004 | Baudat et al. | |
| 2005/0081529 | A1 * | 4/2005 | Bolis et al. | 60/775 |

FOREIGN PATENT DOCUMENTS

| | | | |
|---|---|---|---|
| EP | 0 060 475 | A1 | 7/1994 |
| EP | 1 365 127 | A2 | 11/2003 |
| GB | 2 382 847 | A | 6/2003 |
| JP | 2003-106165 | A | 4/2003 |

* cited by examiner

*Primary Examiner*—Ted Kim
(74) *Attorney, Agent, or Firm*—Buchanan Ingersoll & Rooney PC

(57) ABSTRACT

The present disclosure relates to a method for improving aerdynamic stability of a working fluid flow through a compressor of a turbomachine, in particular through a compressor of gas turbine used for power production, particularly against rapidly changing aero speed of the compressor. The method comprises to introduce a first water mass flow to the working fluid flow of the compressor. Furthermore, the disclosure relates to a turbomachine, in particular a gas turbine, which can be driven according to the above method.

34 Claims, 11 Drawing Sheets

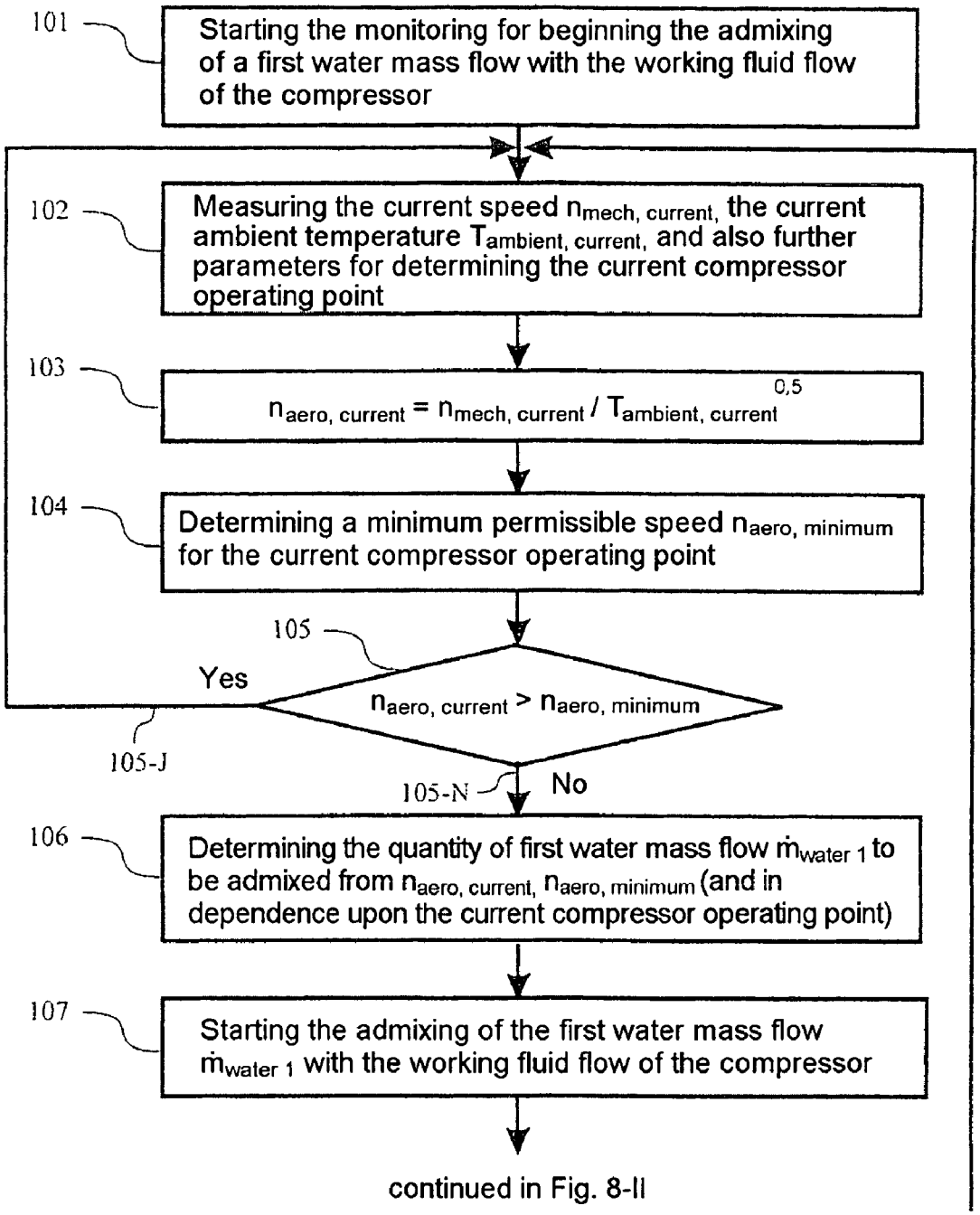
*Fig. 8-I*

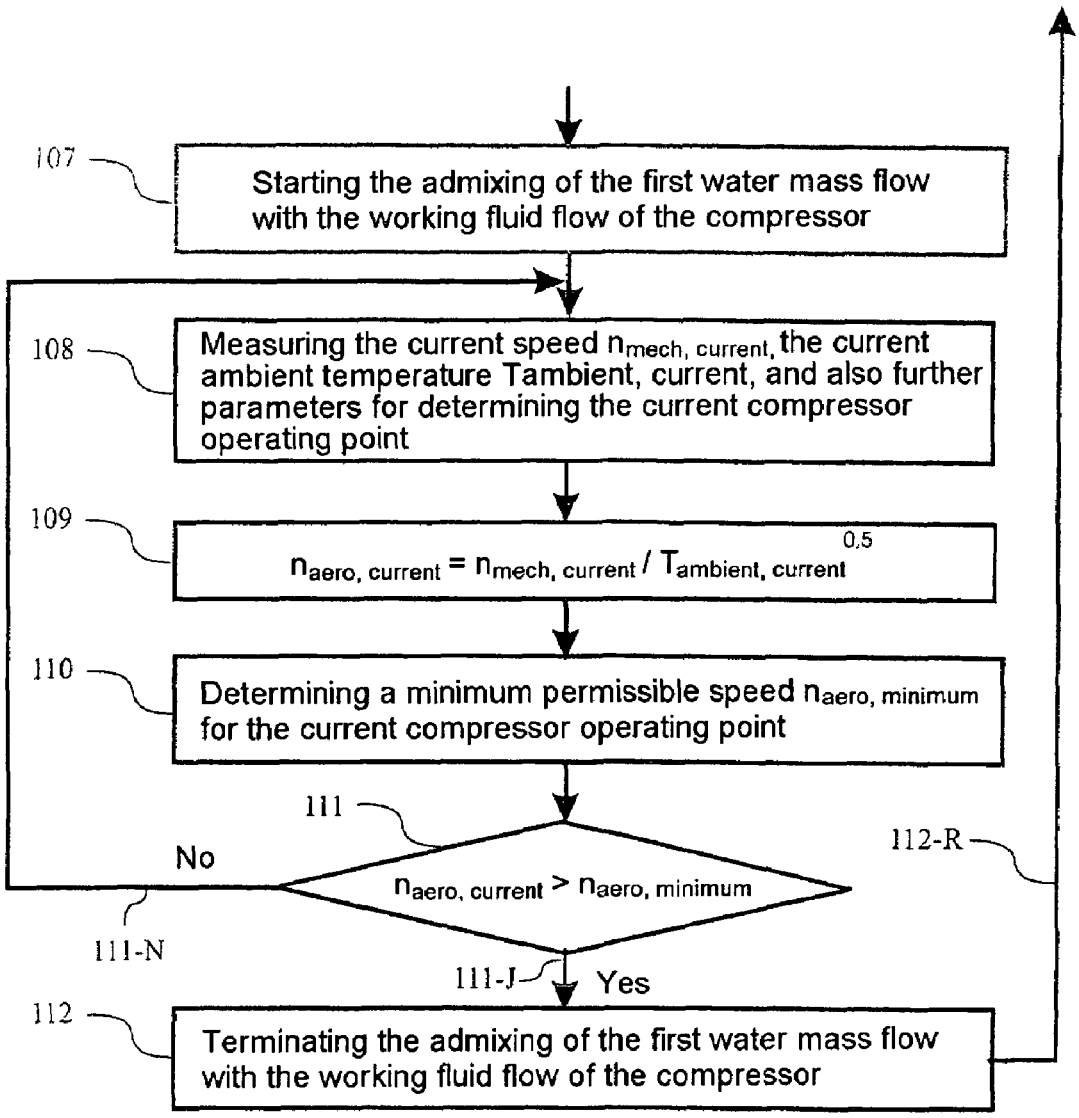
*Fig. 8-II*

METHOD FOR INCREASING THE AERODYNAMIC STABILITY OF A WORKING FLUID FLOW OF A COMPRESSOR

RELATED APPLICATIONS

This application claims priority under 35 U.S.C. §119 to Swiss Application No. 01084/05 filed in the Swiss Patent Office on 27 Jun. 2005, and as a continuation application under 35 U.S.C. §120 to PCT/EP2006/063130 filed as an International Application on 13 Jun. 2006 designating the U.S., the entire contents of which are hereby incorporated by reference in their entireties.

TECHNICAL FIELD

A method for increasing the aerodynamic stability of a working fluid flow of a compressor is disclosed, especially of a compressor of a gas turbine, especially in relation to rapidly changing aerospeeds of the compressor. In addition, the disclosure relates to a turbomachine, especially a gas turbine, in which such a method is used.

BACKGROUND INFORMATION

An especially important requirement for turbomachines, especially gas turbines, which are used in power generating plants for electric power generation, is to ensure an aerodynamically stable operation of the turbomachine under largely all operating conditions which occur. In particular, a quick increasing of the ambient temperature, or a sudden drop of the network frequency of the network, must not be allowed to lead to aerodynamic instabilities of the flow of the respectively relevant compressor of the turbomachine, for example in the form of compressor surges.

Such critical operating conditions are customarily counteracted by means of control intervention by the load of the turbomachine being significantly reduced by means of a quick reduction of the fuel which is supplied.

However, in most cases this leads over a longer period of time to a reduced power output of the turbomachine until the turbomachine can be slowly run up again to its nominal power output. In many cases, the turbomachine, however, can also only be protected against greater damage, as can be caused by a compressor surging, by means of an emergency shutdown. This then means, however, that the turbomachine over a longer period of time completely fails and has to be first run-up again in a costly start-up process and synchronized with the network. A re-synchronization of the turbomachine with the network is also necessary when the turbomachine is decoupled from the system for a short time to avoid an aerodynamic instability.

This influence of ambient temperature and of network frequency which is proportional to the speed of the turbomachine, is reproduced in the parameter "aerospeed":

$$n_{aero}=n_{mech}/T_{ambient}^{0.5}$$

A reduction of the network frequency $n_{mech}$, just as an increase of the ambient temperature $T_{amb}$, leads to a lower aerospeed $n_{aero}$. The lower the aerospeed, the lower is the capability of the compressor of the turbomachine to overcome the forming of aerodynamic instabilities. That is to say, the compressor with lower aerospeed $n_{aero}$ has a smaller interval to the surge limit which limits the stable operating range of the compressor. This interval to the surge limit can be determined as "speed-surge margin"=SSM, which, as plotted in FIG. 2 in a compressor characteristic map 20 as a schematic illustration, is defined as the horizontal interval of the current operating point 24 from the point of intersection of the operating line 23 with the surge limit 22. The so-called "pressure-surge margin" PSM as the vertical interval of the current operating point 24 to the surge limit 22 represents a further stability parameter. This pressure-surge margin PSM, however, basically only plays a role when the compressor, with otherwise unchanged operation, has to deliver at a higher delivery pressure.

The problem of the risk of formation of aerodynamically unstable operating states, which is described above, occurs with increased effect in the case of "older" turbomachines, in which the compressor, as a consequence of operation, has recorded a power output deterioration. In addition to a power output deterioration, aging phenomena also lead to a lowering of the surge limit and consequently to a further reduction of the speed-surge margin SSM. In FIG. 3, in a further compressor characteristic map 20, the operating ranges for a new gas turbine and for a gas turbine which has already been in operation for a longer time, are exemplarily shown for this purpose. The compressor speed lines 21*a*-21*g* are shown as relative aerospeed lines in a range of from 90% to 105%, wherein 100% indicates the nominal operating speed at ISO ambient conditions. While the operating lines 23-1 and 23-2 of the two gas turbines (on account of unchanged throttle conditions) come to coincidently lie one above the other, the surge limit 22-2 which limits the stable operating range of the old compressor, compared with the surge limit 22-1 which applies to the new compressor, is appreciably shifted towards lower pressure ratios. Corresponding to the points of intersection 25-1 and 25-2 between the coinciding operating lines 23-1 and 23-2 and the respective surge limit 22-1 and 22-2, aerodynamic instability occurs at the aerospeed 21*a* (90%) in the case of the new compressor, whereas, however, aerodynamic instability already occurs at the aerospeed 21*b* (92.5%) in the case of the old compressor. Expressed in network frequency of the network and ambient temperature, this means that with a frequency drop of the network of 2.2 Hz, the new compressor would reach the surge limit at an ambient temperature of 50° C., whereas the old compressor would already reach the surge limit at 40° C.

Furthermore, it is also known that at low aerospeeds the aerodynamic instability is initiated in the front stages of the compressor. The stage loading is very high here at low speeds on account of the low mass throughput and the erroneous incident flow of the blades which is associated with it.

If a gas turbine is additionally operated with water injection or steam injection into the combustion chamber for increase of power output, then the compressor must deliver at a higher delivery pressure. This leads to a further increase of load of the compressor. As a result of this, both the speed-surge margin SSM and the pressure-surge margin PSM are reduced.

In addition, in the recent past power supply failures of greater extent were also recorded in addition to increasingly raised ambient temperatures, which led, and will further lead, to a further aggravation of the operating conditions for the turbomachines which are used for electric power generation. An aerodynamically stable operating mode of the turbomachines under all operating conditions in this case will increasingly become of crucial importance.

SUMMARY

The disclosure, therefore, is based on the object of disclosing a method, and also a turbomachine of the type mentioned in the introduction which can be operated according to this method, by which the disadvantages of the prior art are reduced or avoided.

A method for increasing the aerodynamic stability of a working fluid flow of a compressor of a turbomachine is disclosed, especially of a compressor of a gas turbine, especially for increasing the aerodynamic stability of the working fluid flow of the compressor in relation to rapidly changing aerospeeds of the compressor, comprising admixing a first water mass flow with the working fluid flow of the compressor.

A turbomachine, especially gas turbine of a power generating plant, is disclosed with a compressor, a combustion chamber and a turbine which is propulsively connected to the compressor, wherein during operation of the turbomachine, a working fluid flow flows along a flow path through the compressor, the combustion chamber and the turbine one after the other, and also with an admixing device for admixing a first water mass flow with the working fluid flow according to the above method, in order to increase in this way the aerodynamic stability of the working fluid flow which flows through the compressor.

BRIEF DESCRIPTION OF THE DRAWINGS

The disclosure is subsequently explained in more detail with reference to the exemplary embodiments which are illustrated in the figures. In the drawing:

FIG. 6 shows the compressor characteristic map from FIG. 2 with power output characteristic of the compressor during admixing of water according to the disclosure additionally entered in;

FIGS. 8-I and 8-II show in a flow chart the operational sequence of an embodiment of the method according to the disclosure during admixing of a first water mass flow;

Figure 1:
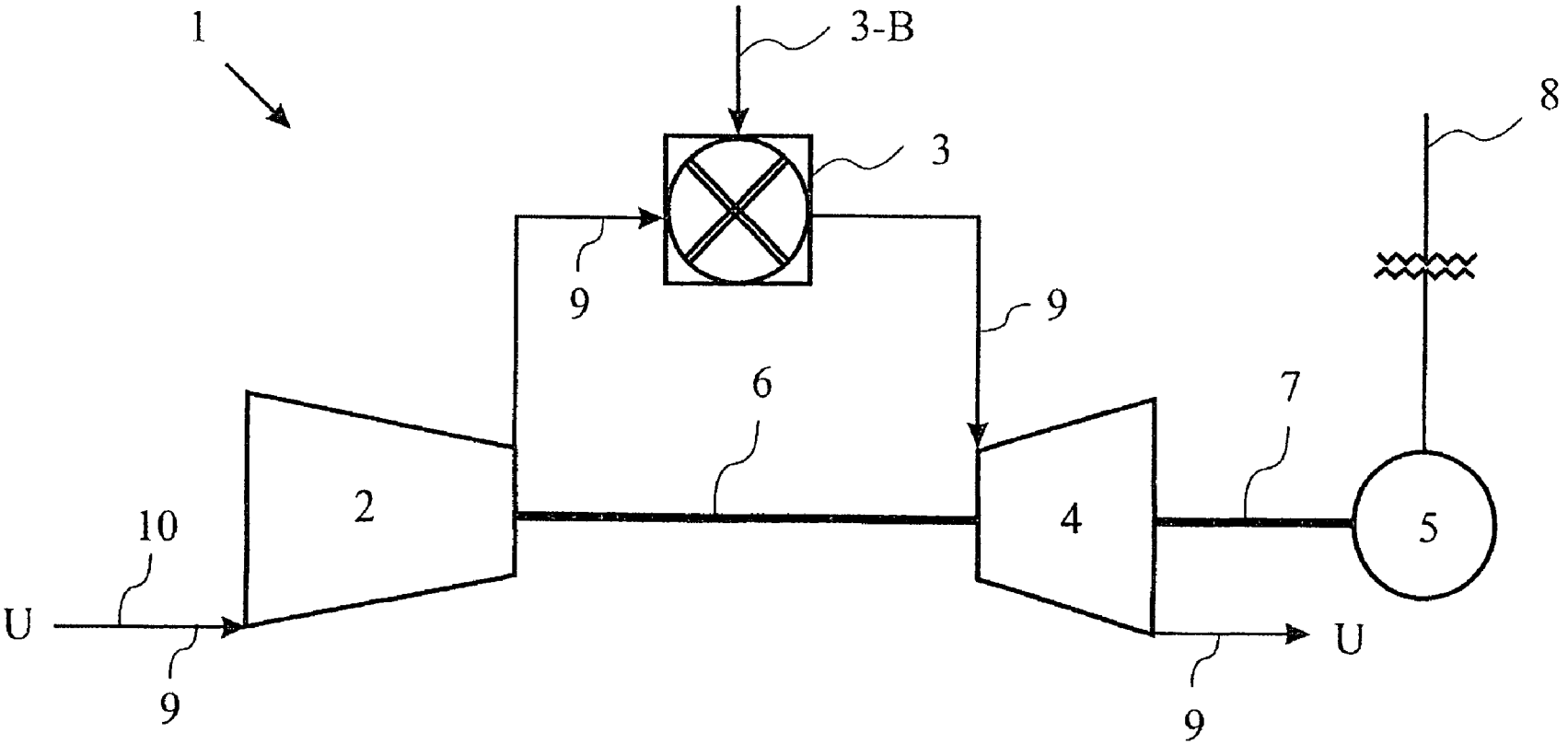
Fig. 1 Prior art
FIG. 1 shows a gas turbine in a schematized representation.

Only the elements and components which are essential for the understanding of the disclosure are shown in the figures.

The exemplary embodiments which are shown are to be purely instructively understood and are to serve for a better understanding of the inventive subject, but not as a limitation of the inventive subject.

DETAILED DESCRIPTION

A method for increasing the aerodynamic stability of a working fluid flow of a compressor of a turbomachine, especially of a gas turbine of a power generating plant, and also a turbomachine which can be operated according to this method, are especially to be made available by means of the disclosure. The increase of the aerodynamic stability of the working fluid flow of the compressor in relation to rapidly changing aerospeeds of the compressor represents a particular aspect in this case.

The method according to the disclosure for increasing the aerodynamic stability of a working fluid flow of a compressor of a turbomachine, especially of a gas turbine of a power generating plant, characterized in that a first water mass flow is admixed with the working fluid flow of the compressor.

According to the conception "mass flow", the admixing of the first water mass flow with the working fluid flow of the compressor is carried out continuously and not only at one or more discrete points in time. The term "water mass flow" is familiar to the person skilled in the art and refers to a continuous mass flow of liquid water over a considered space of time. The water mass flow can be constant within the considered space of time. However, it can also vary over the space of time. That is to say, continuously does not mean that the water mass flow has to remain constant quantity-wise over the considered space of time.

The method according to the disclosure is especially suitable for increasing the aerodynamic stability of the working fluid flow of the compressor in relation to rapidly changing aerospeeds of the compressor. Similarly, however, a working fluid flow which is already in the transition to an unstable operating state can also be stabilized by means of the measure according to the disclosure. Such a stabilization of a working fluid flow which is already in the transition to an unstable state is disclosed.

The disclosure is based on the knowledge that by means of the admixing of water with the working fluid flow of the compressor along at least one flow section of the compressor, which extends downstream of the admixing point, a two-phase flow is created, which comprises the working fluid, as a rule air, and the admixed liquid water in the form of drops or droplets. Since the compressors which are used in turbomachines as a rule comprise a multiplicity of up to 20 and more stages, with an admixing of water in the front section of the compressor a complete evaporation of the water will occur during the passage of flow through the compressor stages. In the section from the admixing to the complete evaporation, which customarily extends over about 5-8 stages, the compressor operates in a so-called "wet mode" on account of the admixing of the water mass flow, i.e. the compressor in this case compresses a 2-phase flow. On account of this, the fluid behavior of the 2-phase flow which occurs here also basically differs from the fluid behavior of a "dry" working fluid flow without admixing of water. Admixing of a water mass flow with the working fluid flow of a compressor generally leads to a "deloading" of the compressor stages which directly follow the mixing point. That is to say, these compressor stages have to produce lower compression temperatures and compression pressures than would be the case without the admixing of the water mass flow. The lower compression pressure inside these stages is established in a throttling effect of the admixed water drops upon the working fluid flow, as a rule air. The lower compression temperatures in turn on the one hand are ascribed to the evaporation of the water drops, and on the other hand also to the reduced compression pressures. By the same token, the compressor stages which are arranged further downstream are higher loaded, since these, on account of the smaller pressure build-up across the stages which directly follow the admixing, with unchanged delivery pressure of the compressor, have to be made wet again.

The more water that is admixed with the working fluid flow, the more intense is the effect of the compression pressure reduction in the section which follows the mixing point, and consequently the aerodynamic deloading of this section and also the increase in aerodynamic stability reserve is developed. (This applies at least for such quantities of water in which the liquid water still inside the compressor completely evaporates).

It is shown that quantity-wise a water mass flow between 0.2% and 1% of the working fluid flow is sufficient in order to achieve an appreciable improvement of the speed-surge margin SSM. In trials, at 1% water feed, an improvement of the speed-surge margin SSM by 3% could be established. In most cases, a mass throughput of the first water mass flow between 0.3% and 0.6% of the mass throughput of working fluid flow will be adequate.

Figure 6:
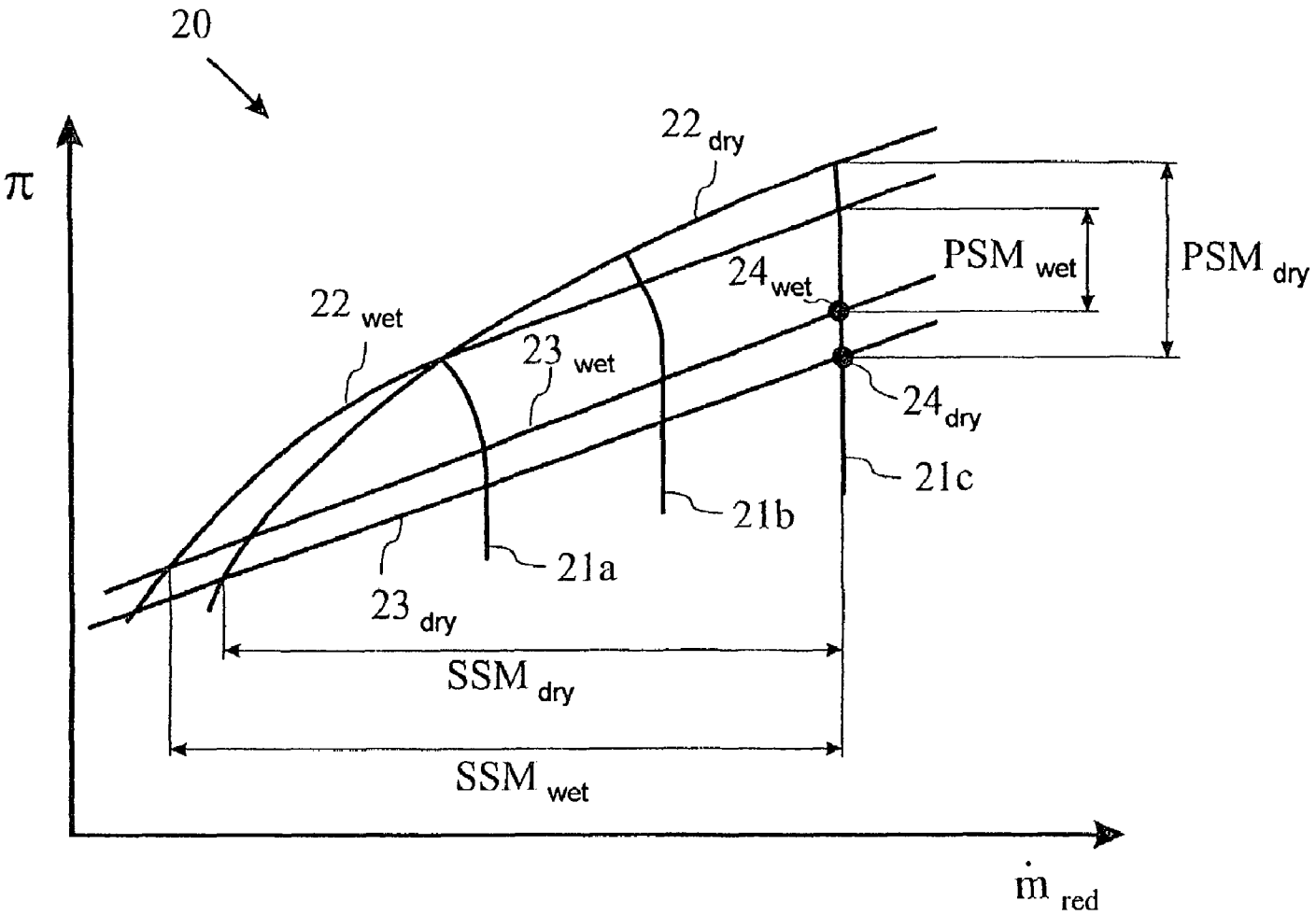

On account of this changed pressure and temperature build-up inside the compressor, and on account of the aerodynamic deloading of the compressor stages which follow the mixing point, which is achieved by means of the admixing of liquid water, with otherwise unchanged flow conditions and operating conditions of the compressor an increased speed-surge margin $SSM_{wet}$ compared with the dry working fluid flow ($SSM_{dry}$) results, as shown in FIG. 6. Correspondingly, the pressure-surge margin PSM is reduced on account of the higher aerodynamic loading of the last stage, and/or of the last stages, of the compressor ($PSM_{wet}$ compared with $PSM_{dry}$).

ever, it became surprisingly apparent that in the case of a speed jump of the compressor which is caused on the network side, and also even in the case of increase of the ambient temperature, the aerodynamically stable operating range of the compressor is significantly limited by the speed-surge margin SSM. The pressure-surge margin PSM in this case plays a secondary role. Furthermore, it became apparent in trials of the inventor that with regard to sudden load increases of the turbomachine, and also with regard to increases of the ambient temperature, a significantly broadened operating range of the compressor and consequently of the whole turbomachine can be achieved as a result of increasing the speed-surge margin SSM.

According to an exemplary embodiment, the admixing of the first water mass flow with the working fluid flow of the compressor is begun during the continuous operation of the turbomachine. That is to say, the operation of the turbomachine is first carried out in the customary manner without admixing of a water mass flow with the working fluid flow. The admixing of the water mass flow is first started upon requirement at a later point in time.

The continuous admixing of the first water mass flow with the working fluid flow is to be expediently begun as soon as a current compressor speed falls below a compressor speed limiting value. The compressor speed limiting value is derived from the nominal compressor speed reduced by a limiting delta value which is dependent upon operating point. The nominal compressor speed is derived in turn from the respective nominal operating point of the compressor, which assumes an uninterrupted operation of the turbomachine at reference ambient conditions. However, if a higher load than the nominal load is impressed upon the turbomachine, for example by an external network, to which the turbomachine which is used for electric power generation is electrically connected, then the compressor speed, correspondingly to the increase of load, drops below the nominal compressor speed. This lowering of the compressor speed, in the case of a load jump, can be very abruptly carried out in the form of a speed jump.

The continuous admixing of the first water mass flow with the working fluid flow is then begun as soon as the current compressor speed falls below the nominal compressor speed by the limiting delta value. It became apparent in this case that by the introduction of the water mass flow into the working fluid flow of the compressor the speed-surge margin SSM can be adequately and quickly increased enough to effectively counteract the formation of an instability of the working fluid flow in the compressor, especially the formation of surging. The working fluid flow, therefore, can be effectively stabilized even in the case of a flow instability which is already in effect. The compressor speed limiting value, during the dropping below of which the admixing is started, or the limiting delta value, as the case may be, is established in dependence upon the compressor and also in dependence upon further external boundary conditions, such as the probability of occurrence of further speed reductions. It is advisable not to drop a speed-surge margin below limits by about a third of the nominal speed-surge margin.

In many application cases, however, it will also be expedient to then begin the continuous admixing of the first water mass flow with the working fluid flow as soon as a current ambient temperature exceeds an ambient temperature limiting value. As a result of this, an unstable flow of the working fluid in the compressor of the turbomachine, owing to a too high ambient temperature, can be prevented from forming.

If both sudden increases of load and increased ambient temperatures are not to be ruled out for a turbomachine, then a monitoring of the aerospeed is especially expedient. In this case, the two aforementioned criteria of the maximum permissible deviation of the compressor speed and also of the maximum permissible deviation of the ambient temperature in combination with each other, are used as a starting condition for starting the admixing of the first water mass flow, wherein compressor speed and ambient temperature are expressed in relationship with each other in accordance with the definition of the aerospeed. The continuous admixing of the first water mass flow with the working fluid flow is begun as soon as the current aerospeed of the compressor falls below an aerospeed limiting value.

the admixing of the first water mass flow is only started in the case of requirement, then it is expedient to also terminate again the continuous admixing of the first water mass flow with the working fluid flow as soon as the current compressor speed exceeds the compressor speed limiting value by a speed delta value, and/or the current ambient temperature falls below the ambient temperature limiting value by a temperature delta value, and/or the current aerospeed exceeds the aerospeed limiting value by an aerospeed delta value. The respective delta values are to be established depending upon the respective compressor and established individually. For avoiding oscillations of control around the respective limiting value the delta values should not be equal to zero.

In this way, for a turbomachine operated under steady state conditions which can be used for electric power generation, in which the ambient temperature customarily lies between 10° C. and 30° C., for example it can be expedient to select a value between 40° C. and 45° C., for example 40° C., for the temperature limiting value at which the admixing of the first water mass flow with the working fluid flow is started, and to select a value between 35° C. and 40° C., for example 38° C., for the temperature limiting value at which the admixing is terminated again.

For increasing the effectiveness of the method, it is furthermore of advantage to measure the first water mass flow in dependence upon the deviation of the current compressor speed from the compressor speed limiting value, and/or upon the deviation of the current ambient temperature from the temperature limiting value, and/or upon the deviation of the current aerospeed from the lower aerospeed limiting value. The water mass flow in this case can amount to several percent of the mass flow of the working fluid, wherein the effect of deloading the front compressor stages, and therefore the gain in speed-surge margin SSM, with simultaneously increased load of the rear compressor stage(s), and therefore loss in pressure-surge margin PSM, is intensified with increasing water mass flow.

Alternatively to an admixing of the first water mass flow with the working fluid flow upon requirement, however, it can also be expedient to continuously admix the first water mass flow with the working fluid flow during the whole operating period of the turbomachine. This admixing which lasts over the whole operating period is especially suitable for turbomachines or compressors which have already been in operation for longer and which owing to aging effects have a permanently poor surge limit characteristic with lower pressure ratios and therefore lower stability reserves. By the admixing of water with the compressor flow the surge limit characteristic which is relevant for the speed-surge margin SSM can again be shifted towards higher pressure ratios so that a stable operation of the compressor with adequate stability reserve is possible without having to overhaul the turbomachine or the compressor. In this case, the amount of first water mass flow can also be varied depending upon requirement over the period or can also be kept constant.

However, it can also be expedient to undertake admixing of the first water mass flow with the working fluid flow of the compressor during the start-up and running-up process of a turbomachine in order to additionally aerodynamically stabilize in this way the working fluid flow during the start-up process. After running-up of the turbomachine has been carried out, and/or as soon as an adequate speed-surge margin SSM is achieved, the admixing of the first water mass flow with the working fluid flow of the compressor can then be terminated again.

The first water mass flow is preferably admixed with the working fluid flow in an evenly distributed manner over the circumference of the compressor, or approximately evenly distributed over the circumference of the compressor. An uneven admixing of the first water mass flow over the circumference of the compressor would lead to an uneven flow profile of the working fluid flow over the circumference of the compressor downstream of the admixing point.

Furthermore, it is expedient to admix the first water mass flow with the working fluid flow by atomization. For this purpose, suitable nozzles for atomization of the first water mass flow are familiar to the person skilled in the art. By means of atomization, the water mass flow is split into fine and extremely fine droplets, and, as a result, can quickly evaporate in the working fluid flow. By means of this, a direct effectiveness of the water injection is already achieved at the point at which the water is injected into the working fluid flow.

At least some of the first water mass flow is preferably admixed with working fluid flow upstream of the inlet of the working fluid flow into the compressor. In many application cases, it will be expedient to admix the entire first water mass flow with the working fluid flow upstream of the inlet into the compressor, in order to deload in this way the front stages of the compressor.

In the case of multistage compressors, however, it can also be of advantage to admix at least some of the first water mass flow with the working fluid flow in a compressor stage downstream of the first compressor stage of the compressor. The location of admixing some of the first water mass flow depends upon the stage loading of the compressor and should be carried out in a region directly upstream of the compressor stage which is loaded the most up to approximately three compressor stages upstream of the compressor stage which is loaded the most, in order to effectively deload in this way the compressor stage which is loaded the most. The determination of the load distribution is known to the person skilled in the art. In this case, it is to be simply noted that the admixing of the first water mass flow is effective over approximately 6-8 compressor stages. Downstream of the approximately 6-8 compressor stages, the supplied water mass flow is customarily evaporated so that aerodynamic deloading of the subsequent compressor stages is no longer carried out here.

For temporary or even for permanent increase of power output of a gas turbine, to add water to the working fluid flow of this gas turbine in the combustion chamber is known to the person skilled in the art. Within the scope of the disclosure, it can also be expedient here, for increasing the power output of the relevant turbomachine, to couple such an admixing of a second water mass flow with the working fluid flow of the turbomachine in the region of the combustion chamber with the admixing of the first water mass flow with the working fluid flow.

These admixings of the two water mass flows can be carried out at the same time. The admixing of the second water mass flow in the combustion chamber which serves for increasing the power output of the turbomachine is customarily permanently operated, or at least over a longer period of time, whereas the admixing of the first water mass flow in the region of the compressor can be carried out over a shorter period of time.

Such a simultaneous admixing of the two water mass flows, however, leads to a very high loading of the rear stage, or the rear stages, of the compressor. This loading of the rear stage(s) of the compressor, as well as the pressure-surge margin PSM which results from this, should then be accurately determined in order to avoid a flow separation on account of too high pressure loading in the rear stage(s) of the compressor.

Therefore, it will often be expedient to reduce the second water mass flow, at least by a portion, at the same time as the beginning of the admixing of the first water mass flow with the working fluid flow. For this purpose, the reduced portion of the second water mass flow is expediently partially or completely used as first water mass flow and admixed with the working fluid flow, as a result of which only a common provision of water for the two water mass flows is required. As regards equipment engineering, this can be realized via a controlled branch in the feed line.

In many application cases, however, the admixing of the two water mass flows is carried out with a time stagger in relation to each other.

In a further aspect, the disclosure makes available a turbomachine, especially a gas turbine of a power generating plant, with a compressor, a combustion chamber and a turbine which is propulsively connected to the compressor. During operation of the turbomachine, a working fluid flow flows along a flow path through a compressor, combustion chamber and turbine one after the other. Furthermore, the turbomachine comprises an admixing device for admixing a first water mass flow with the working fluid flow according to the method which is described above, in order to increase in this way the aerodynamic stability of the working fluid flow which flows through the compressor. The advantages which can be achieved by this, and also further developments, correspond to the embodiments which are dealt with above in conjunction with the method according to the disclosure.

The admixing device expediently leads into the flow path upstream of the compressor so that the working fluid flow is already interspersed with water during entry into the compressor. As a result of such an arrangement of the admixing device upstream of the compressor, it can be ensured that the working fluid flow inside the first stages of the compressor is aerodynamically deloaded on account of the water admixing and consequently has an increased aerodynamic stability.

With a compressor of multistage design, the admixing device, however, can also lead into the flow path in a region of a compressor stage which follows the first compressor stage. If water is fed via the admixing device which is arranged in this manner, then a deloading of the compressor stages which are arranged downstream of the admixing device is achieved in the process. Such an arrangement of the admixing device downstream of the first compressor stage, especially with compressors with a multiplicity of compressor stages, for example 20 and more compressor stages, plays a role, since a water mass flow which is fed upstream of the first compressor stage is evaporated after approximately 8-10 compressor stages, and therefore by means of a feed of the water mass flow exclusively upstream of the first compressor stage, no aerodynamic deloading of the compressor stages downstream of approximately the $10^{th}$ compressor stage would be achievable.

The admixing of the water mass flow is expediently carried out by means of atomization. Nozzles which are suitable for atomization of water are known to the person skilled in the art. The admixing device expediently comprises at least one nozzle ring, and/or at least one nozzle grid, which in each case comprise a multiplicity of nozzles.

In addition, the turbomachine expediently comprises a control device, by means of which the admixing of the first water mass flow with the working fluid flow is controlled according to the method which is described above. The detection of operating states which are critical to stability, and aerodynamically critical load states of the compressor based on aerodynamic loading and/or ambient temperature and/or aerospeed criteria which are presented above, the start and stop regulating of the first water mass flow and also, if applicable, the quantity adjustment of the first water mass flow, are especially the responsibility of the control device.

FIG. 1 shows in schematized representation a turbomachine which is formed as a gas turbine 1 and known from the prior art. Such gas turbines for example are used in power generating plants for electric power generation and especially serve for covering peak loads. Such a gas turbine which is used for electric power generation represents a typical field of application of the disclosure. The method according to the disclosure, however, can also be applied to other turbomachines.

The gas turbine 1 comprises as essential components, which are shown in FIG. 1, a compressor 2, a combustion chamber 3 with fuel feed lines 3-B, and also a turbine 4. In stationary gas turbines, which are used for electric power generation, the compressor 2 customarily comprises a multiplicity of up to 20 and more compressor stages. The turbine customarily comprises 4 to approximately 8 turbine stages. The individual compressor stages and turbine stages are not shown in FIG. 1.

Furthermore, a generator 5 is associated with the gas turbine 1 for electric power generation and is electrically connected to a network 8 to which the generated power is supplied.

During operation of the gas turbine 1, both the compressor 2 and the generator 5 are driven by the turbine 4. For this purpose, the turbine 4 is connected in a torsionally fixed manner via a first shaft 6 to the compressor 2, and connected via a second shaft 7 to the generator 5.

Compressor 2, combustion chamber 3 and turbine 4 form a flow path 9 which is indicated in FIG. 1 by means of flow arrows. During operation of the gas turbine 1, air, which is inducted from the atmosphere U via an inlet duct 10, flows along the flow path 9 through the gas turbine 1. The air which is inducted from the atmosphere therefore forms here the working fluid of the gas turbine. (In the combustion chamber fuel is additionally added to the air, which is combusted in the combustion chamber, forming a flue gas). After compression which is carried out in the compressor 2, fuel is admixed with the compressed air in the combustion chamber 3, and the fuel-air mixture is then combusted. The flue gas-air mixture which flows from the combustion chamber then expands via the turbine 4 and finally flows out again into the environment U. The flue gas-air mixture, which is expanded in the turbine, in this case first drives the turbine 4, and via the shafts 6 and 7 also drives the compressor 2 and also the generator 5.

Construction, principal of operation and also technical developments of such gas turbines, as shown in FIG. 1, are sufficiently known to the person skilled in the art from the prior art, and so at this point a further-reaching explanation is dispensed with.

Figure 2:
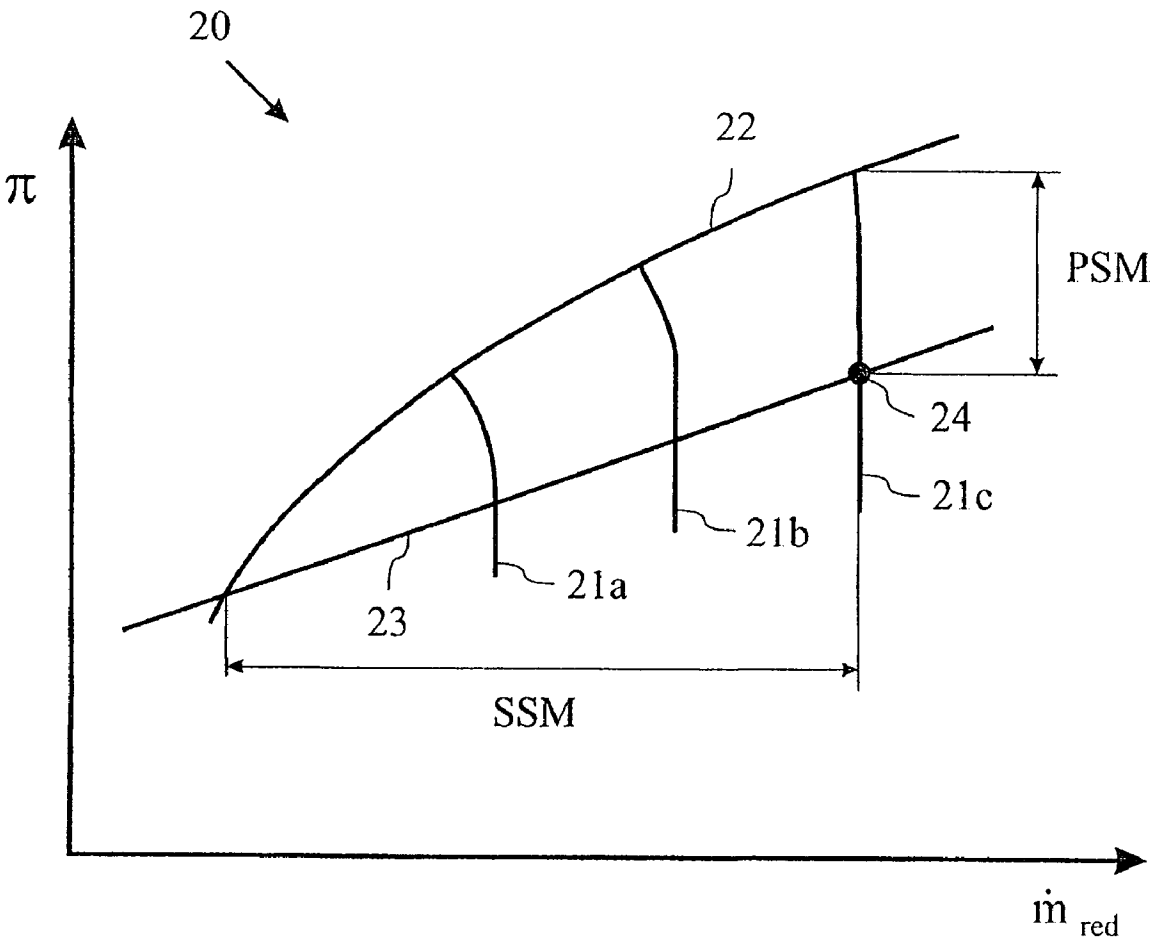
Prior art Fig. 2
FIG. 2 shows a compressor characteristic map in a basic representation.

FIG. 2 shows in a basic representation a compressor characteristic map 20 which is known from the prior art. The reduced mass throughput $m_{red}$ Of the compressor is plotted on the x-axis, and the pressure ratio $\pi$ is plotted on the y-axis. For constantly maintained aerospeeds of the compressor in each case, with increasing throttling, the aerospeed lines 21*a*, 21*b* and 21*c* of the compressor are produced, which lines extend in a crescent-shaped manner and open in each case to the left. The operating range, in which the working fluid of the compressor stably operates, i.e. largely without flow separation, is limited by greater mass throughput occurring as a result of the surge limit 22. In the region beyond the surge limit, the region on the upper left in the characteristic map 20, stable compressor operation is no longer possible. The position of the operating line 23 of the compressor, and in this case especially the position of the nominal operating point 24, as a rule is selected so that all operating points which are arranged on the operating line 23 have a sufficient interval to the surge limit 22. This interval to the surge limit is customarily determined either for constantly maintained mass throughput, which leads to the so-called pressure-surge margin PSM, or the horizontal interval from the relevant operating point to the point of intersection of the operating line with the surge limit 22, which leads to the so-called speed-surge margin SSM, is determined. In FIG. 2, the pressure-surge margin PSM and also the speed-surge margin SSM are shown in each case for the nominal operating point 24. The pressure-surge margin PSM is primarily relevant when the gas turbine experiences an increasing throttling. This plays a rather secondary role for stationary gas turbines which are used for electric power generation. The speed-surge margin SSM on the other hand is relevant when the aerospeed of the gas turbine is abruptly reduced, which, for example, is the case with an abrupt increase of the load which is impressed upon the gas turbine by the generator. This then leads to an abrupt shift of the operating point towards lower aerospeeds associated with an abrupt reduction of the speed-surge margin SSM. The control system of the gas turbine in the case of an abrupt load increase is not customarily in the position to readjust in the short term the aerospeed of the gas turbine to the initial value. Similarly, an increase of the ambient temperature also leads to a reduction of the speed-surge margin SSM.

Figure 3:
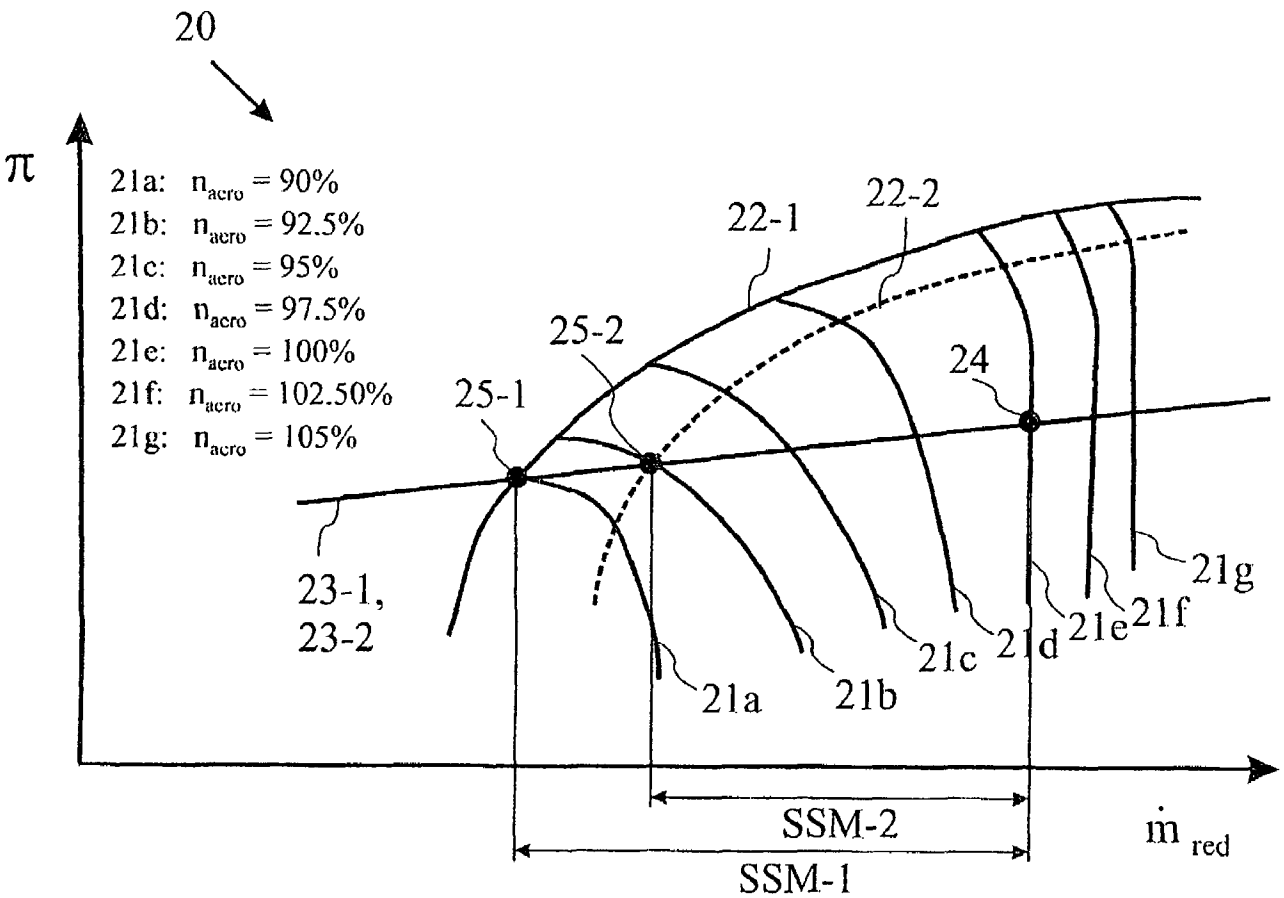
Prior art Fig. 3
FIG. 3 shows power output characteristics of a new compressor and an old compressor compared with each other.

The power output characteristics of a new compressor and also of an old compressor of similar construction in comparison with each other, are shown in FIG. 3. In case of the old compressor, it concerns a compressor which was already in operation for some time and which, therefore, has customary operating phenomena, such as increased tip clearances or eroded airfoil trailing edges. In the compressor characteristic map 20 which is shown in FIG. 3, these aging phenomena are made apparent by means of a shift of the surge limit 21-1, which applies to the new compressor, towards a surge limit characteristic 21-2 with lower pressure ratios and greater mass throughputs (surge limit 21-1 applies to the new compressor; surge limit 21-2 applies to the old compressor).

Owing to the shift of the surge limit 21-1 towards 21-2, the operating line 23-2 of the old compressor (which extends coincidentally with the operating line 23-1 of the new compressor) intersects the surge limit 21-2 already at a higher aerospeed 21*b* than in the case of the new compressor, where the point of intersection of the operating line 23-1 with the surge limit 21-1 first occurs at an aerospeed 21*a*. The aerospeed 21*a* corresponds to 90% aerospeed with regard to the aerospeed at the nominal operating point with nominal ambient conditions, whereas the aerospeed 21*b* corresponds to 92.5%. This deterioration of the surge limit for the old compressor leads to a deterioration of the speed-surge margin SSM from SSM-1 to SSM-2 at the nominal operating point. In the example which is shown, the shift of the point of intersection of the operating line 23-1 or 23-2, as the case may be, with the surge limit from 90% aerospeed to 92.5% aerospeed, leads to the flow of the old compressor, at an ambient temperature of 40° C. and a drop of a 50 Hz network frequency of the network, which is connected to the generator, by 2.2 Hz, becoming unstable. In the case of the new compressor, a frequency drop of 2.2 Hz would first lead to an unstable compressor flow at 50° C. ambient temperature.

Figure 4:
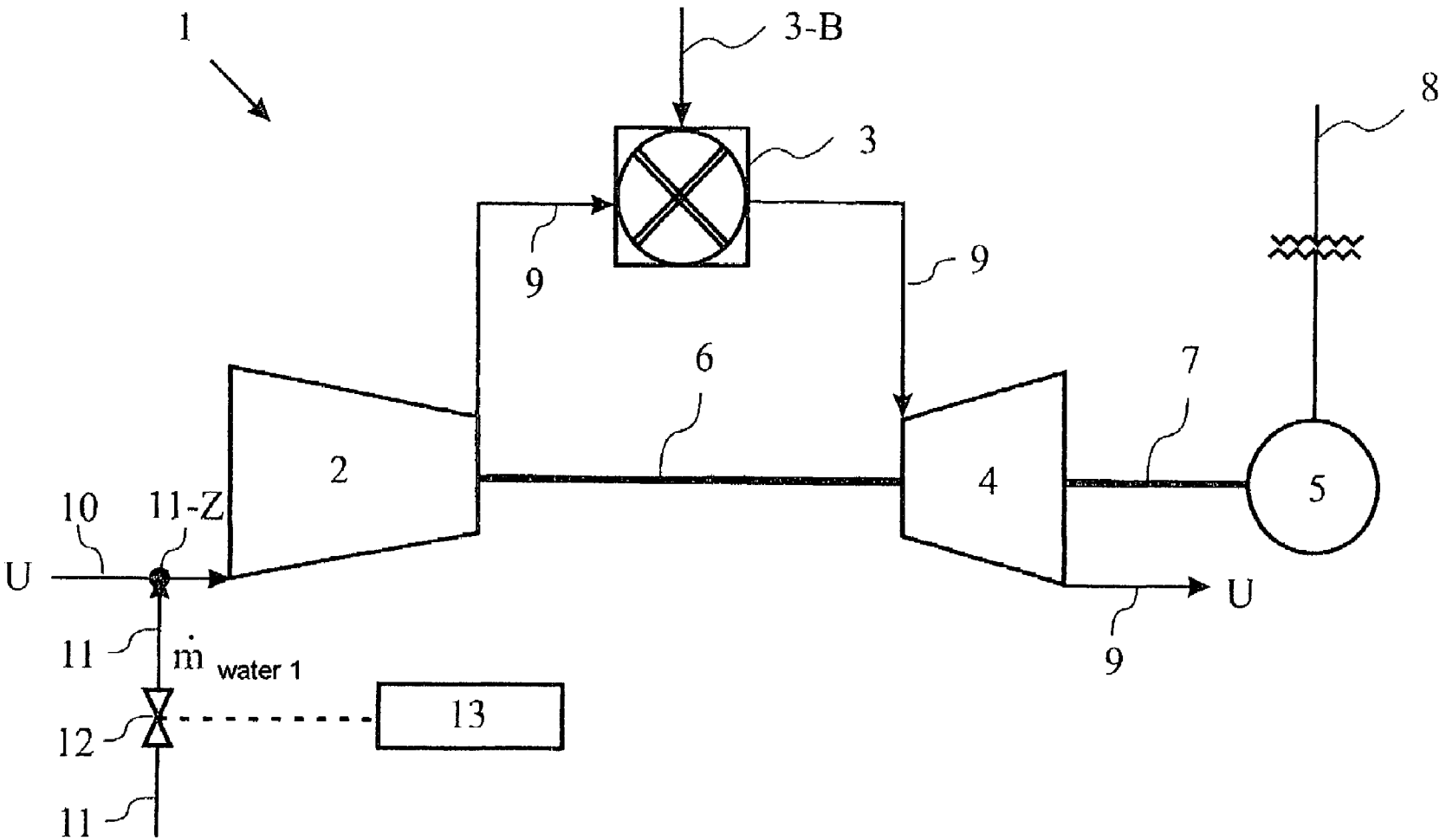
FIG. 4 shows a gas turbine which is constructed according to the disclosure, with admixing of a first water mass flow according to the disclosure upstream of the compressor inlet.

A first gas turbine 1 which is constructed according to the disclosure is shown in FIG. 4. The construction of the gas turbine 1 largely corresponds to the construction of the gas turbine which is shown in FIG. 1. However, in this case in addition to the gas turbine which is shown in FIG. 1, in accordance with the method according to the disclosure a first water mass flow $m_{water\ 1}$ can be admixed with the working fluid flow of the compressor 2. As also in the case of the gas turbine which is already shown in FIG. 1, air, which is inducted from the atmosphere, serves as working fluid in this case. The admixing of the first water mass flow $m_{water\ 1}$ is carried out at an admixing point 11-Z upstream of the inlet into the compressor 2, so that the working fluid flow of the compressor 2 is already interspersed with water during entry into the compressor 2. In order to introduce the first water mass flow $m_{water\ 1}$ into the working fluid flow of the compressor 2 in a finely distributed manner, a plurality of nozzle rings, in each case with a multiplicity of nozzles, are installed in the inlet duct 10 of the compressor 2 for this purpose. The first water mass flow $m_{water\ 1}$ is fed via a feed line 11 from a reservoir (not shown in FIG. 4) to the nozzles, and via these, is injected into the working fluid flow. Nozzle rings and nozzles are not shown in FIG. 4; these are known to the person skilled in the art, however, from other applications. Instead of nozzle rings or other injection devices which are to be specially provided, an existing washing device, as long as this is designed for the required water mass throughput, can also be used for atomization of the first water mass flow.

The quantity control of the first water mass flow $m_{water\ 1}$ is carried out in this case by means of a control valve 12 which is integrated into the feed line 11 and which is controlled by a control device 13. The control device 13 can be formed as part of a central gas turbine control system.

Figure 5:
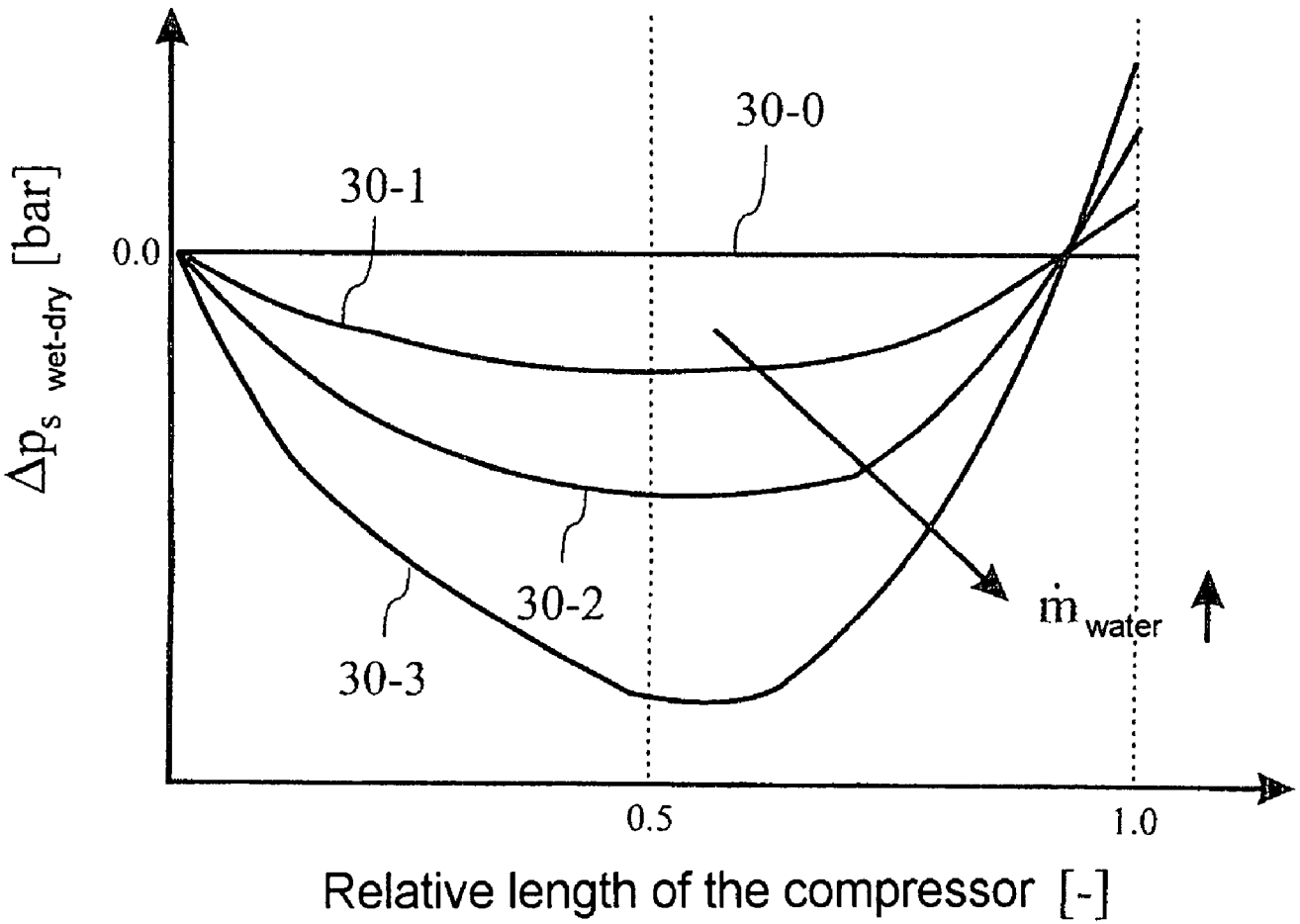
FIG. 5 shows the progression of the pressure build-up along a compressor during admixing of different quantities of water.

FIG. 5 shows the pressure build-up along a multistage compressor during admixing of different quantities of water compared with the pressure build-up of a dry working fluid flow without admixing of water. The admixing of the water mass flow in this case is carried out upstream of the inlet into the compressor, as shown in FIG. 4.

The pressure build-up $\Delta p_{s\ wet\text{-}dry}$ of the compressor in bar for a dry working fluid flow 30-0, and also for three wet working fluid flows 30-1, 30-2 and 30-3, with which an increasing quantity of water was admixed in each case in ascending order, is plotted here against the relative length of the compressor. The greater the water mass flow $m_{water}$ which is introduced into the compressor flow, the more intense is the effect of reducing the pressure build-up in the region which follows the mixing point, and therefore the effect of aerodynamic deloading of the compressor stages which are located in this region. By the same token, the last compressor stage, or the last compressor stages, as the case may be, is, or are, increasingly more heavily loaded as water mass flow increases. This last compressor stage, or last compressor stages, however, in nominal operating mode customarily has, or have, the largest stability reserve, so that with increasing water mass flow a gain in aerodynamic stability reserve for the compressor is altogether produced.

In FIG. 6 it is shown how the admixing of a first water mass flow has an effect on the operating line and also on the characteristic of the surge limit in the compressor characteristic map 20 from FIG. 2. The admixing is also carried out in this case upstream of the inlet into the compressor, wherein the statements basically also apply to an admixing of the water mass flow in the region of one of the compressor stages which follow the first compressor stage.

On the one hand, as a result of admixing water with the working fluid flow of the compressor, an extension of the operating line 23 ($\mathbf{23}_{dry}$ to $\mathbf{23}_{wet}$) towards higher pressure ratios occurs. This is contingent upon the throttling action of the admixed water after evaporation. On the other hand, however, the characteristic of the surge limit 22 ($\mathbf{22}_{dry}$ to $\mathbf{22}_{wet}$) is also altered to the effect that the surge limit $\mathbf{22}_{dry}$ in the lower mass flow region is shifted towards higher pressure ratios. In the upper mass flow region, however, a reduction of the achievable pressure ratio occurs. As a result of the admixing of water, corresponding to the applications, a reduction of the pressure-surge margin PSM (change from $PSM_{dry}$ to $PSM_{wet}$) altogether occurs with regard to the nominal operating point 24 ($\mathbf{24}_{dry}$ to $\mathbf{24}_{wet}$), whereas, however, an appreciable increase of the speed-surge margin SSM occurs (change from $SSM_{dry}$ to $SSM_{wet}$).

Figure 7A:
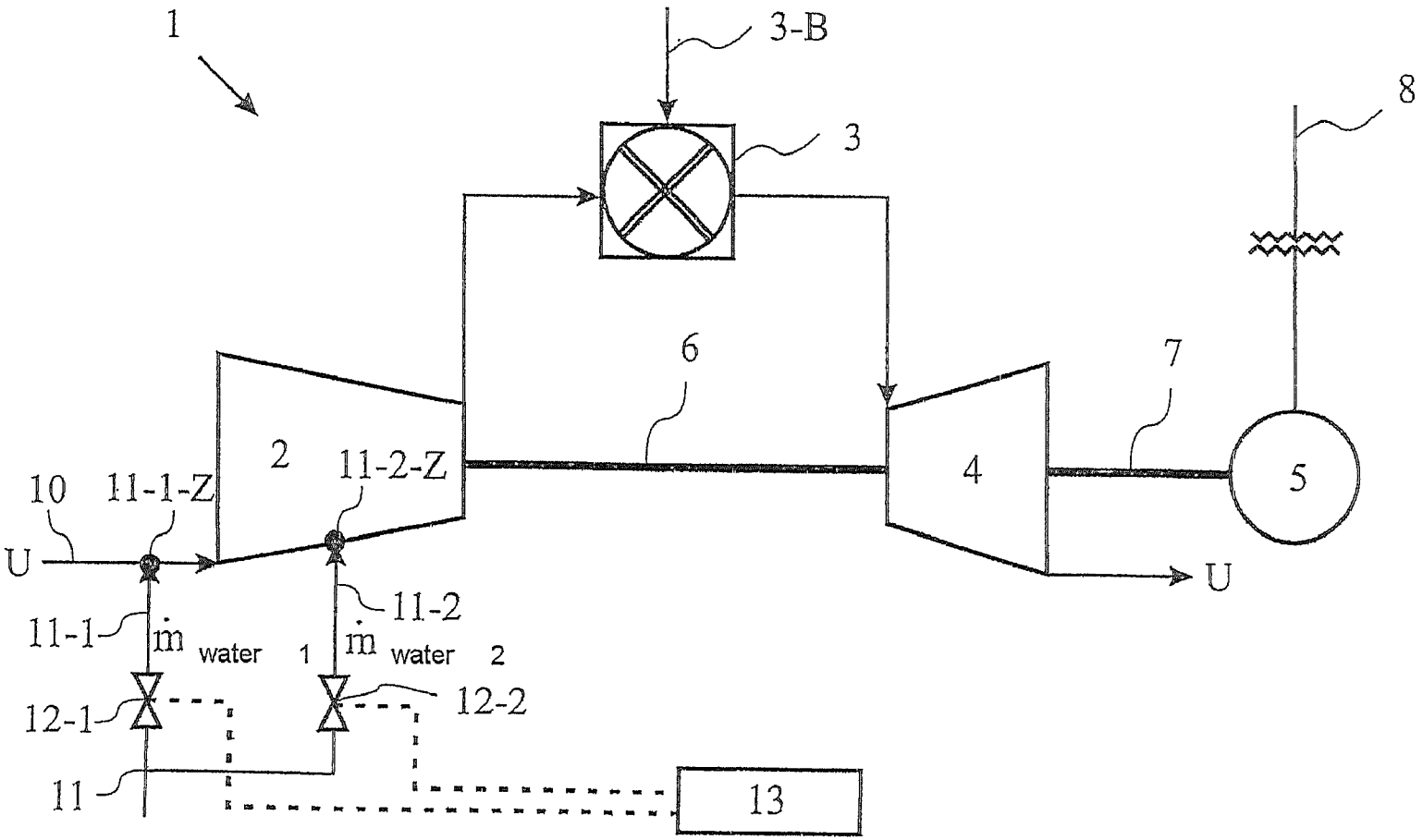
FIG. 7A shows a further gas turbine which is constructed according to the disclosure, with distributed admixing of the first waster mass flow.
Figure 7B:
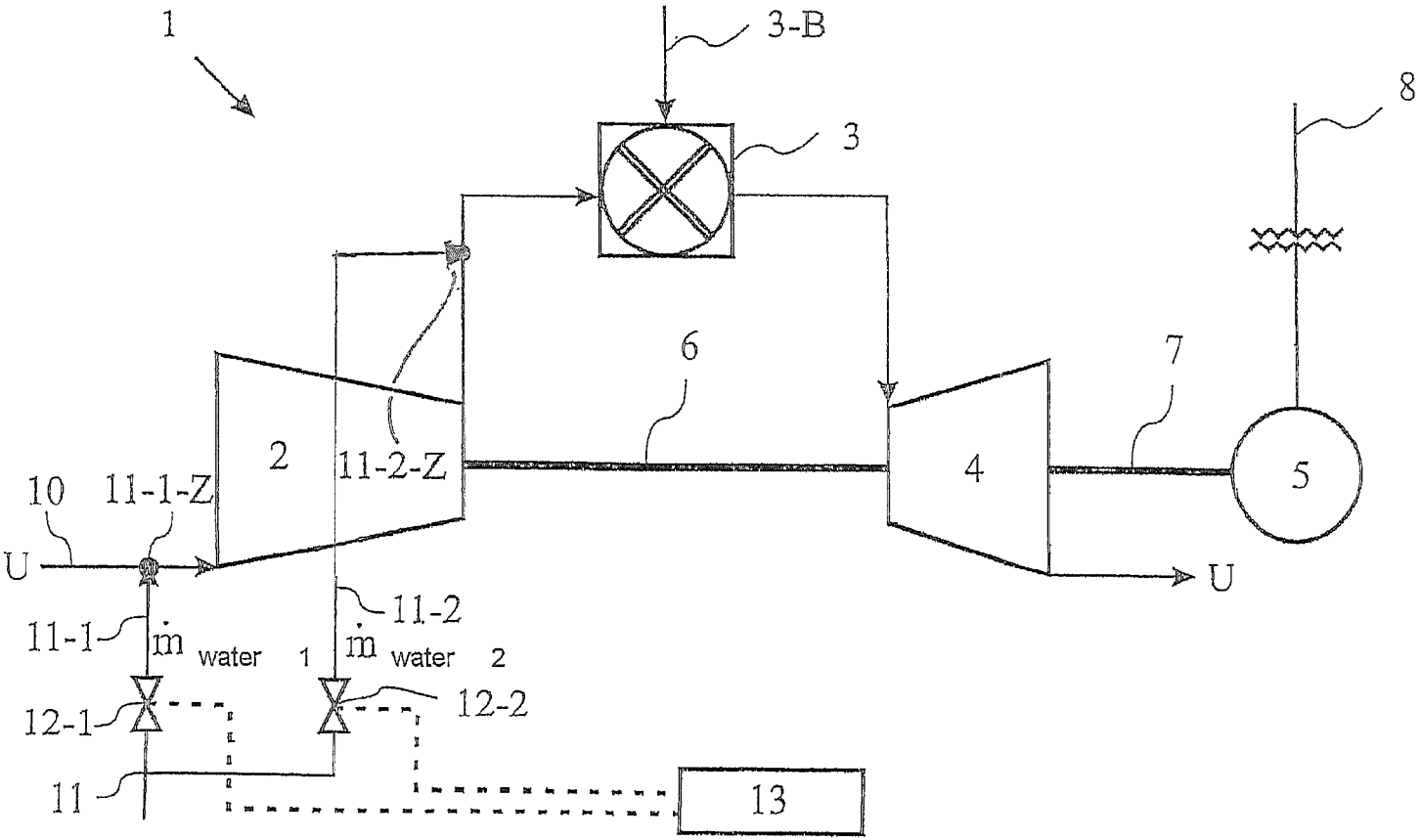
FIG. 7B shows a further gas turbine which is constructed according to the disclosure, with the distributed admixing of a water mass flow.

FIG. 7A shows a further gas turbine 1 which is constructed according to the disclosure with distributed admixing of the first water mass flow via a first admixing point 11-1-Z and a second admixing point 11-2-Z. The admixing of the first water mass flow $m_{water\ 1}$ in this case can be carried out both upstream of the first compressor stage and approximately in the middle of the compressor inside a compressor stage which is arranged downstream of the first compressor stage. Such a distributed admixing is especially expedient in the case of a multistage compressor with a number of stages which is greater than about 10 stages. In the case of a 15-stage compressor, for example, the first admixing point should be arranged upstream of the compressor inlet, and the second admixing point arranged approximately in the region of the $6^{th}$-$8^{th}$ compressor stage. On the one hand, by means of an introduction of water via the first admixing point or via the second admixing point, a purposeful influencing of the currently highly loaded compressor stages in each case can be carried out in this way. As speed increases, the load is customarily shifted from the front compressor stages, which are arranged upstream, to the rear compressor stages, which are arranged downstream. However, water can also be admixed with the working fluid flow of the compressor 2 at the same time via the two admixing points in order to achieve in this way a simultaneous aerodynamic deloading of as many compressor stages as possible. The two admixing points 11-1-Z and 11-2-Z here comprise in each case a plurality of nozzle rings with a multiplicity of nozzles in each case, which lead into the inlet duct or flow passage of the compressor 2. The quantity of admixed water mass flow in this case can be distributed equally to the two admixing points, or distributed in unequal portions. More than two admixing points can also be arranged. FIG. 7B shows admixing a second water mass flow with the working fluid flow downstream of the compressor in a region of a combustion chamber of the turbomachine.

The controlling of the control valves 12-1 and 12-2, via which the mass flows of the first and the second water mass flow are adjusted, is also carried out here again by means of the control device 13. The control device 13 can also here again be formed as part of a central gas turbine control system.

FIGS. 8-I and 8-II show in a flow chart the operational sequence of an embodiment of the method according to the disclosure during admixing of a first water mass flow. According to the method sequence which is shown here, the admixing of the first water mass flow is not permanently carried out during the operation of the turbomachine. Such a permanent operating mode certainly makes sense especially in the case of older compressors, which have already been in operation for quite some time, for improving the stability reserves which have deteriorated by aging effects. Such a permanent admixing of the first water mass flow, however, makes no special demands as regards control engineering but is started with the running-up of the turbomachine. The admixed water mass flow can simply be varied depending upon operating point of the compressor. An admixing of the first water mass flow $m_{water\ 1}$ upon requirement, as shown in FIGS. 8-I and 8-II, is more expensively designed as regards control engineering. The requirement case is when a starting condition which is to be monitored is fulfilled. Concerning this, the monitoring of the starting condition is started in the method step 101 in FIG. 8-I.

A starting condition, for example, can be an abrupt speed drop of the compressor or of the turbomachine below a minimum speed. Such abruptly occurring speed jumps occur in the case of electric power generating gas turbines, for example, when the load of the network which is connected to the generator suddenly increases. Such an abrupt increase of the load can be ascribed to a suddenly increased power demand. This is the case, for example, when a large consumer is suddenly hooked up. A further reason for an abrupt speed drop can also be the failure of a further turbomachine which serves for electric power generation, or failure of a complete power generating plant. This also leads to an abrupt increase of the load which is being applied to the generator.

A further starting condition can be an exceeding of the ambient temperature beyond a maximum permissible ambient temperature.

As shown in FIG. 8, these two starting conditions, however, can also be coupled with each other according to the definition of the aerospeed $n_{aero}=n_{mech}/T_{ambient}^{0.5}$. In this case, the currently existing aerospeed in each case (method steps 102 and 103) must not fall below (method step 105) a minimum value (method step 104) which applies to the operating point. In the case of falling below the minimum value according to sequence step 105-N, in method step 106 the quantity of first water mass flow which is to be admixed is determined on the basis of the current aerospeed $n_{aero,\ current}$, the minimum aerospeed $n_{aero,\ minimum}$, and also the current compressor operating point. The admixing of the first water mass flow $m_{water\ 1}$ is then started (method step 107), as a result of which the speed-surge margin SSM increases, and consequently the aerodynamic stability reserve of the compressor flow increases. If now either the ambient temperature and/or the speed of the turbomachine or of the compressor increases again, so that the current aerospeed then lies above the minimum value, then the admixing of the first water mass flow is terminated again (method steps 108-112). For the minimum value, which has to be exceeded for terminating the admixing, however, a value which by a delta value is higher than for the minimum value at which the admixing is started, should be expediently selected in order to avoid a control engineering-related oscillating around this minimum value.

A variable metering of the mass throughput of first water mass flow is not shown in FIG. 8. The quantity of the admixed first water mass flow in this case is dependent upon the deviation in each case of the current speed, and/or ambient temperature, and/or aerospeed in each case from the predetermined limiting value in each case.

Figure 9:
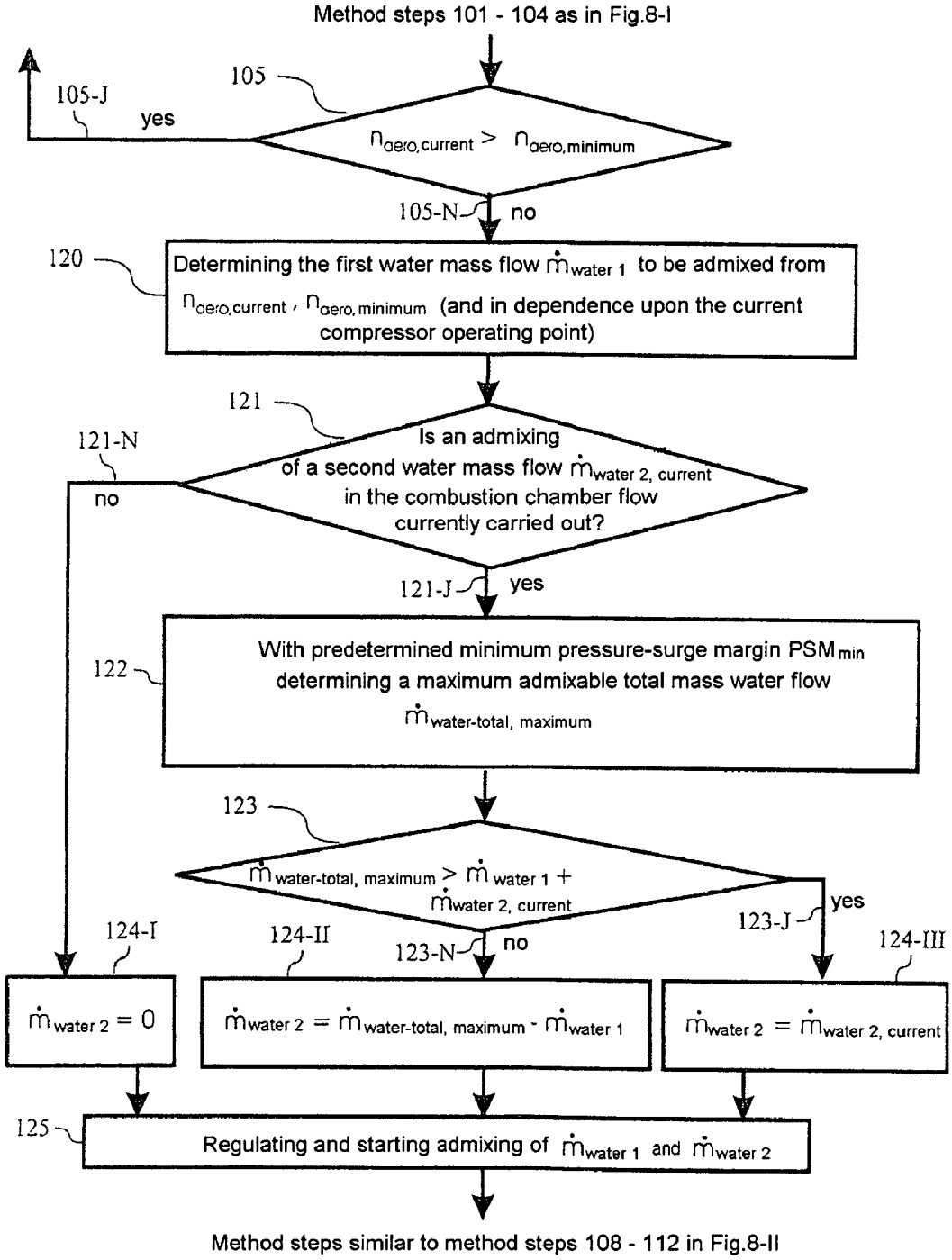
FIG. 9 shows in a flow chart the operational sequence of a further embodiment of the method according to the disclosure during admixing of a first and a second water mass flow.

Furthermore, in FIG. 9 the operational sequence of a further embodiment of the method according to the disclosure during admixing of a first water mass flow $m_{water\ 1}$, and also of a second water mass flow $m_{water\ 2}$, is shown in a flow chart. While the admixing of the first water mass flow $m_{water\ 1}$ with the working fluid flow is carried out upstream of the inlet into the compressor, and is carried out with the aim of increasing the aerodynamic stability of the working fluid flow of the compressor, the second water mass flow $m_{water\ 2}$, for increasing the delivered power output of the turbomachine, is admixed with the working fluid flow in the region of the combustion chamber. It is basically possible to admix the two water mass flows with the working fluid flow of the gas turbine at the same time. However, this will often not be expedient or even not feasible, since as a result of this a too small pressure-surge margin PPM would be brought about, or the surge limit would even be exceeded.

Therefore, the admixing of the second water mass flow $m_{water\ 2}$ is in most cases reduced, or completely terminated, during starting of the admixing of the first water mass flow $m_{water\ 1}$. In this case, the portion of the second water mass flow $m_{water\ 2}$, by which the second water mass flow $m_{water\ 2}$ was reduced, is expediently bypassed and used as first water mass flow. Such a bypassing can be realized by means of a simple 3/2 directional valve which is integrated into the feed line and controlled by the control device.

The method which is shown in FIG. 9 starts similarly to FIG. 8-I with the 25 method steps 101-104. As soon as the starting condition for admixing the first water mass flow $m_{water\ 1}$ according to method step 105 is fulfilled, the quantity of the first water mass flow $m_{water\ 1}$ which is to be admixed is determined (method step 120) and then checked whether a second water mass flow $m_{water\ 2}$ is currently admixed in the combustion chamber flow (method step 121). With a positive result of this check, the maximum permissible total water mass flow $m_{water\ total,\ maximum}$ is determined in accordance with method step 122, wherein falling below a minimum pressure-surge margin $PSM_{min}$ must not take place. In the method steps 123 and 124-II or 124-III (or even 124-I, so long as no second water mass flow is admixed), the quantity of second water mass flow, which is subsequently admixed with the combustion chamber flow, is then determined. Finally, in method step 125 the quantity of first water mass flow $m_{water\ 1}$ which is to be admixed, and also the quantity of second water mass flow $m_{water\ 2}$ which is to be admixed, are adjusted and the admixings started. The method steps which subsequently follow this proceed similarly to the method steps 108-112 from FIG. 8-II.

The embodiments which are described here of the method according to the disclosure, and also of the turbomachine according to the disclosure, only represent exemplary embodiments of the disclosure which can be perfectly supplemented and/or modified in multifarious ways by a person skilled in the art, without abandoning the inventive idea.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

| List of designations | |
|---|---|
| 1 | Gas turbine |
| 2 | Compressor |
| 3 | Combustion chamber |
| 3-B | Fuel feed |
| 4 | Turbine |
| 5 | Generator |
| 6 | First shaft |
| 7 | Second shaft |
| 8 | Network |
| 9 | Flow path of the working fluid flow |
| 10 | Inlet duct of the compressor |
| 11, 11-1, 11-2 | Feed line |
| 11Z, 11-1-Z, 11-2-Z | Admixing point |
| 12, 12-1, 12-2 | Control valve |
| 13 | Control device |
| 20 | Compressor characteristic map |
| 21a-21g, $21_{dry}$, $21_{wet}$ | Aerospeed lines |
| 22, 22-1, 22-2 | Surge limit |
| 23, 23-1, 23-2, $23_{dry}$, $23_{wet}$ | Operating line |
| 24, $24_{dry}$, $24_{wet}$ | Nominal operating point |
| 25-1, 25-2 | Points of intersection of the operating line and the surge limit |
| 30-0 | Compressor pressure characteristic for dry working fluid flow |
| 30-1, 30-2, 30-3 | Compressor pressure characteristic for wet working fluid flow |
| 101-112 | Method steps |
| 105-J, 105-N, 111-J, 111-N | Go-to instructions |
| 112-R | Go-to instruction |
| 120-125 | Method steps |
| 121-J, 121-N, 123-J, 123-N | Go-to instructions |
| $\dot{m}_{red}$ | Reduced mass throughput |
| $\dot{m}_{water\ 1}$ | First water mass flow |
| $\dot{m}_{water\ 2}$ | Second water mass flow |
| $n_{aero}$ | Aerospeed ($n_{aero} = n_{mech}/T_{ambient}^{0.5}$) |
| $n_{mech}$ | (Mechanical) speed |
| PSM, $PSM_{dry}$, $PSM_{wet}$ | Pressure-surge margin |
| SSM, SSM-1, SSM-2 $SSM_{dry}$, $SSM_{wet}$ | Speed-surge margin |
| $T_{ambient}$ | Ambient temperature |

-continued

| List of designations | |
|---|---|
| U | Environment |
| $\Delta p_s$ | Pressure difference |
| $\Pi$ | Pressure ratio |

What is claimed is:

1. A method for increasing the aerodynamic stability of a working fluid flow of a compressor of a turbomachine in relation to changing aerospeeds of the compressor, comprising:

determining a total water mass flow based on a predetermined surge margin;

admixing a first water mass flow with the working fluid flow of the compressor to control the aerodynamic stability of the working fluid flow of the compressor and the surge margin, the first water mass flow being determined based on compressor operating conditions;

admixing a second water mass flow with the working fluid flow downstream of the compressor in a region of a combustion chamber of the turbomachine; and reducing the second water mass flow, at least by a portion, at a beginning of the admixing of the first water mass flow with the working fluid flow to control the surge margin.

2. The method as claimed in claim 1, furthermore comprising:

continuously admixing the first water mass flow with the working fluid flow of the compressor during operation of the turbomachine.

3. The method claimed in claim 2, furthermore comprising:

beginning admixing of the first water mass flow with the working fluid flow of the compressor during continuous operation of the turbomachine.

4. The method claimed in claim 2, furthermore comprising:

beginning the continuous admixing of the first water mass flow with the working fluid flow as soon as a current compressor speed fails below a compressor speed limiting value.

5. The method claimed in claim 2, furthermore comprising:

beginning the continuous admixing of the first water mass flow with the working fluid flow as soon as a current ambient temperature exceeds an ambient temperature limiting value.

6. The method as claimed in claim 2, furthermore comprising:

beginning the continuous admixing of the first water mass flow with the working fluid flow as soon as a current aerospeed falls below an aerospeed limiting value.

7. The method as claimed in claim 2, furthermore comprising:

measuring the first water mass flow in dependence upon deviation of a current compressor speed from a compressor speed limiting value, and/or upon deviation of a current ambient temperature from an upper temperature limiting value, and/or upon deviation of a current aerospeed from a lower aerospeed limiting value.

8. The method as claimed in claim 7, furthermore comprising:

terminating the continuous admixing of the first water mass flow with the working fluid flow as soon as the current compressor speed exceeds the compressor speed limiting value by a speed delta value, and/or the current ambient temperature falls below the ambient temperature limiting value by a temperature delta value, and/or the current aerospeed exceeds the aerospeed limiting value by an aerospeed delta value.

9. The method as claimed in claim 2, furthermore comprising:

continuously admixing the first water mass flow with the working fluid flow during the whole operating period of the turbomachine.

10. The method as claimed in claim 2, furthermore comprising:

admixing the first water mass flow with the working fluid flow in an evenly distributed manner over a circumference of the compressor, or approximately evenly distributed over the circumference of the compressor.

11. The method as claimed in claim 10, furthermore comprising:

admixing the first water mass flow with the working fluid flow by means of atomization.

12. The method as claimed in claim 11, furthermore comprising:

admixing at least some of the first water mass flow with the working fluid flow upstream of the inlet of the working fluid flow into the compressor.

13. The method as claimed in claim 12, wherein the compressor is a multistage compressor, and the method comprises:

admixing at least some of the first water mass flow with the working fluid flow in a compressor stage downstream of a first compressor stage of the compressor.

14. The method as claimed in claim 13, furthermore comprising:

admixing a second water mass flow with the working fluid flow downstream of the compressor in a region of a combustion chamber, for increasing the power output of the turbomachine.

15. The method as claimed in claim 1, furthermore comprising:

beginning admixing of the first water mass flow with the working fluid flow of the compressor during continuous operation of the turbomachine.

16. The method as claimed in claim 1, furthermore comprising:

beginning a continuous admixing of the first water mass flow with the working fluid flow as soon as a current compressor speed falls below a compressor speed limiting value.

17. The method as claimed in claim 1, furthermore comprising:

beginning a continuous admixing of the first water mass flow with the working fluid flow as soon as a current ambient temperature exceeds an ambient temperature limiting value.

18. The method as claimed in claim 1, furthermore comprising:

beginning a continuous admixing of the first water mass flow with the working fluid flow as soon as a current aerospeed falls below an aerospeed limiting value.

19. The method as claimed in claim 1, furthermore comprising:

measuring the first water mass flow in dependence upon the deviation of a current compressor speed from a compressor speed limiting value, and/or upon deviation of a current ambient temperature from an upper temperature limiting value, and/or upon deviation of a current aerospeed from a lower aerospeed limiting value.

20. The method as claimed in claim 1, furthermore comprising:

terminating a continuous admixing of the first water mass flow with the working fluid flow as soon as a current compressor speed exceeds a compressor speed limiting value by a speed delta value, and/or a current ambient temperature falls below an ambient temperature limiting value by a temperature delta value, and/or a current aerospeed exceeds an aerospeed limiting value by an aerospeed delta value.

21. The method as claimed in claim 1, furthermore comprising:

continuously admixing the first water mass flow with the working fluid flow during a whole operating period of the turbomachine.

22. The method as claimed in claim 1, furthermore comprising:

admixing the first water mass flow with the working fluid flow in an evenly distributed manner over a circumference of the compressor, or approximately evenly distributed over the circumference of the compressor.

23. The method as claimed in claim 1, furthermore comprising:

admixing the first water mass flow with the working fluid flow by means of atomization.

24. The method as claimed in claim 1, furthermore comprising:

admixing at least some of the first water mass flow with the working fluid flow upstream of the inlet of the working fluid flow into the compressor.

25. The method as claimed in claim 1, wherein the compressor is a multistage compressor, and the method comprises:

admixing at least some of the first water mass flow with the working fluid flow in a compressor stage downstream of a first compressor stage of the compressor.

26. The method as claimed in claim 1, furthermore comprising:

admixing a second water mass flow with the working fluid flow downstream of the compressor in a region of a combustion chamber of the turbomachine, for increasing a power output of the turbomachine.

27. The method as claimed in claim 1, furthermore comprising:

partially admixing a reduced portion of the second water mass flow with the working fluid flow, or completely as first water mass flow.

28. The method as claimed in claim 1, wherein a mass throughput of the first water mass flow is between 0.2% and 1% of the working fluid flow.

29. The method as claimed in claim 28, wherein a mass throughput of the first water mass flow is between 0.3% and 0.6% of the working fluid flow.

30. The method as claimed in claim 29, wherein an upper temperature limiting value for a beginning of the admixing lies between 40° C. and 45° C., and/or a lower temperature limiting value, at which the admixing is terminated again, lies between 35° C. and 40° C.

31. The method as claimed in claim 30, comprising:

recuperating aerodynamic stability reserves of a compressor which have been reduced owing to aging effects.

32. The method as claimed in claim 1, wherein an upper temperature limiting value for a beginning of the admixing lies between 40° C. and 45° C., and/or a lower temperature limiting value, at which the admixing is terminated, lies between 35° C. and 40° C.

33. The method as claimed in claim 1, comprising:

recuperating aerodynamic stability reserves of a compressor which have been reduced owing to aging effects.

34. A method for increasing the aerodynamic stability of a working fluid flow of a compressor of a turbomachine in relation to changing aerospeeds of the compressor, comprising:

determining a total water mass flow based on a predetermined surge margin;

admixing a first water mass flow with the working fluid flow of the compressor to control the aerodynamic stability of the working fluid flow of the compressor and the surge margin, the first water mass flow being determined based on compressor operating conditions;

admixing a second water mass flow with the working fluid flow downstream of the compressor in a region of a combustion chamber of the turbomachine;

reducing the second water mass flow, at least by a portion, at a beginning of the admixing of the first water mass flow with the working fluid flow; and using the reduced portion of the second water mass flow completely as the first water mass flow to admix with the working fluid to control the surge margin.

* * * * *